US005351660A

United States Patent [19]

Logozzo

[11] Patent Number: 5,351,660

[45] Date of Patent: Oct. 4, 1994

[54] ELECTRICALLY ACTIVATED DYNAMIC VALVE FOR SPARK IGNITION ENGINES

[76] Inventor: Michael Logozzo, 48541 I-94 Service Dr., Apt. 206, Belleville, Mich. 48111

[21] Appl. No.: 86,538

[22] Filed: Jul. 1, 1993

[51] Int. Cl.[5] ..... F02B 33/04

[52] U.S. Cl. ..... 123/73 V

[58] Field of Search ..... 123/90.11, 73 V, 73 D

[56] References Cited

U.S. PATENT DOCUMENTS

| | | | |
|---|---|---|---|
| 2,428,791 | 10/1947 | Earnshaw | 123/73 V |
| 4,158,352 | 6/1979 | Blatter | 123/119 DB |
| 4,363,302 | 12/1982 | Fischinger | 123/337 |
| 4,760,825 | 8/1988 | Morita | 123/340 |
| 4,875,447 | 10/1989 | Kiuchi et al. | 123/339 |
| 4,879,976 | 11/1989 | Boyesen | 123/651 |
| 4,901,682 | 2/1990 | Everts | 123/73 V |
| 4,940,031 | 7/1990 | Mann | 123/339 |
| 4,970,996 | 11/1990 | Matsuo et al. | 123/73 V |
| 5,125,370 | 6/1992 | Kawamura | 123/90.11 |
| 5,161,494 | 11/1992 | Brown, Jr. | 123/90.11 |

FOREIGN PATENT DOCUMENTS

| | | | |
|---|---|---|---|
| 1291813 | 3/1962 | France | 123/73 D |
| 14241 | of 1916 | United Kingdom | 123/90.11 |

*Primary Examiner*—Noah P. Kamen

*Attorney, Agent, or Firm*—James M. Diemen

[57] ABSTRACT

An inlet manifold active reed valve for an internal combustion spark ignition engine comprises a solenoid activated reed just upstream of the inlet poppet valve of a four stroke engine. For a two stroke engine the active reed valve is located at the entrance to the crankcase and activated by one or more miniature solenoids attached to the valve body. As an alternative, the new valve is a rotary disc valve reciprocated by an external solenoid or a rotary activator. The valve opens fully for full unrestricted flow (unthrottled) during a portion of the time the inlet valve or part is open (in terms of crankshaft angle). The portion of crankshaft angle the new valve is fully open is determined by the engine load. Under full load the new valve may be held constantly open to provide unrestricted flow to the engine inlet valve or crankcase. In the above embodiments an electronic control unit energizes the solenoid or activator in response to engine operating conditions and pollution control regulations.

2 Claims, 6 Drawing Sheets

ELECTRICALLY ACTIVATED DYNAMIC VALVE FOR SPARK IGNITION ENGINES

BACKGROUND OF THE INVENTION

The field of the invention pertains to spark ignition internal combustion engines, and in particular, to engines that use a throttling plate and passive valves in the inlet flow circuit to each cylinder. Such throttling plates and passive valves cause throttling losses that reduce engine thermodynamic efficiency, especially under part load conditions.

Examples of modern reed valve assemblies for diesel engines are disclosed in U.S. Pat. No. 4,970,996 and for high performance spark ignition engines in U.S. Pat. No. 4,879,976. In both disclosures the reeds are positioned on wedge shaped supports located in the inlet passage to the cylinder. The reeds open passively in response to a relative vacuum downstream of the reeds.

U.S. Pat. No. 4,901,682 illustrates another form of reed valve wherein the valve body is formed of insulating material. U.S. Pat. No. 4,158,352 discloses a small flapper valve mounted on a throttle plate. The flapper valve operates to assist in air intake during the initial cranking phase of engine start-up.

The above examples all illustrate passively operated reed valves, however, actively operated throttle valves of various forms are known. U.S. Pat. No. 4,363,302 discloses a cam operated flat slotted slide valve. The fixed slots are formed by a plurality of air foils mounted in the intake passage. A flat slotted plate is reciprocally driven by the cam, U.S. Pat. No. 4,940,031 discloses a solenoid employed to set the idle opening position of a throttle plate in either of two slightly open throttle plate settings. U.S. Pat. No. 4,875,447 discloses a solenoid controlled valve in a passage communicating between the upstream and downstream sides of a pair of throttle plates. To control the amount of suction air, an electronic control unit operates the solenoid in response to various engine operating conditions. And U.S. Pat. No. 4,760,825 discloses a throttle plate rotated by an electronic control unit in response to various engine operating conditions. The device includes an air flow meter in the inlet passage.

SUMMARY OF THE INVENTION

The invention comprises a new approach to eliminating throttling losses in spark ignition engines. In four stroke engines which are either naturally aspirated, turbo-charged or supercharged the throttle plate is eliminated and replaced by an active or dynamic valve actuated by a solenoid. The solenoid in turn is controlled by an electronic control unit in response to both engine load demand signals and a number of engine parameter monitoring sensor signals. The active valve is preferably located in the inlet manifold as close to the cylinder inlet valve as possible. Fully opened, the valve provides no significant impediment to the flow of inlet charge air to the inlet valve. Fully closed, the inlet charge air flow through the active valve is stopped fully. In addition, the inlet charge air trapped in the manifold between the fully closed active valve and inlet valve is at substantially the cylinder pressure at the instant the inlet valve closes because the active valve is timed to close prior to the inlet valve under all partial engine load conditions except load conditions that correspond to wide open throttle operation over the full spectrum of engine speeds, in the throttle controlled engine.

With active valve control the duration of time is measured in crank angle degrees and the active valve is timed to close prior to the inlet valve under most part load operating conditions.

At speed and load conditions in the engine where throttling is not necessary ("wide open throttle") the active valve can be logically controlled in any one of several possible modes. The active valve may remain continuously fully open; may open and close at the same crank angle as the inlet valve; may open prior to the inlet valve opening and close subsequent to the inlet valve closing; may open prior to the inlet valve opening and close at the same crank angle as the inlet valve closes; or may open at the same crank angle as the inlet valve opens and close at a crank angle subsequent to the closing of the inlet valve.

With an active valve engine operating at part load, during the portion of the inlet stroke that the active valve is open, the mass flow rate of the inlet charge into to the combustion chambers is higher than with a similar throttle controlled engine of equal size, power output, volumetric efficiency and geometry. Since the active valve eliminates the inlet charge flow restriction during the inlet stroke associated with a closed or partially closed throttle valve, complete cylinder charging at part load occurs more quickly in the active valve controlled engine.

In its simplest embodiment the active valve comprises a single moveable reed located in the intake manifold just upstream from the combustion chamber inlet valve in a four stroke spark ignition engine. The reed is actuated (moved to the open and closed positions) by a small connecting rod attached to a simple solenoid, or other activator. In more sophisticated versions disclosed below the actuator may be embodied as an electric solenoid, hydraulic or pneumatic activator, or electric motor. The active valve may be embodied as a poppet valve, multiple reeds mounted on a wedge shaped valve body having miniature electromagnetic actuators within the wedge and connected to the reeds, or rotary slotted disc valves.

The moveable slotted disc rotationally reciprocates in response to a solenoid controlled by an electronic control unit. The rotary slotted disc, although requiring a more powerful actuator, is inherently sturdier in construction than a reed with a connecting rod attached thereto.

DESCRIPTION OF THE PREFERRED EMBODIMENTS

Figure 1:
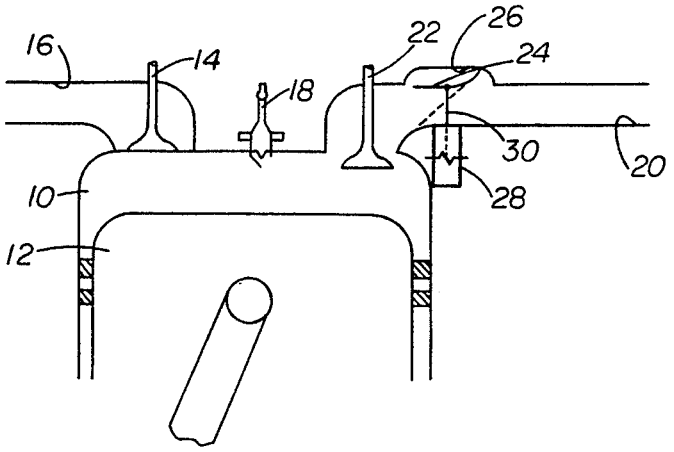
FIG. 1 is a schematic drawing of the active reed valve in an engine inlet manifold.

In FIG. 1 the top of a cylinder 10 and piston 12 are illustrated. The cylinder 10 includes an exhaust valve 14 leading to an exhaust manifold 16. A spark plug 18 is inserted into the cylinder 10. An inlet passage in the form of an inlet manifold 20 also communicates with the cylinder through an inlet valve 22.

The new active valve 24 is shown fully open and retracted in a side cavity 26 in the inlet manifold 20. With the reed valve 24 fully open there is no impediment to the flow of air or air/fuel mix through the inlet manifold and therefore no throttling in the inlet manifold 20 to the engine. The inlet valve 22 is shown open also. Under full load operation the new reed valve 24 may remain constantly open thereby eliminating thermodynamic losses due to throttling.

The new reed valve 24 is activated by a solenoid 28 and connecting pin 30. Under less than full load engine operation the solenoid 28 and reed valve 24 are activated to fully open during a portion of each inlet stroke of the engine, the object being to vary the inlet charge into the cylinder in accordance with load but without any flow restriction or throttling. Rather, the amount of air or air/fuel mix introduced into the cylinder is determined by the time in crank angle degrees the reed valve 24 is open during the inlet stroke. The open time of the reed valve 24 is determined by various engine operating parameters sensed and electronically manipulated by an electronic control unit. A variety of engine electronic control units for spark ignition engines are now available to control the spark timing, fuel injection timing and amount of fuel delivered to the cylinder, therefore such an electronic control unit can be used to activate the solenoid 28 and reed valve 24 in the same manner.

The major advantage to the new reed valve 24 lies in the unrestricted flow of air or air/fuel mix through the inlet manifold 20 even under low load or idle engine operation. The reed valve 24 fully opens for a crank angle time sufficient to supply the necessary mass of air or air/fuel mix to the cylinder but without substantial throttling. The single active reed valve per cylinder is applicable to four cycle engines and two cycle poppet valved and supercharged engines that are not crankcase scavenged.

Figure 2A:
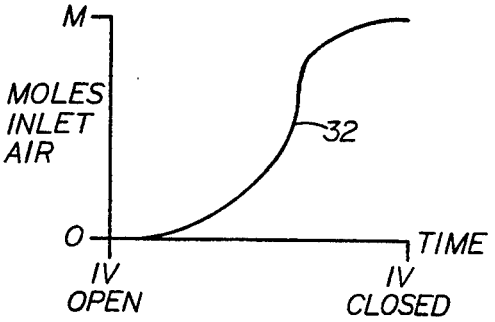
FIGS. 2*a* and 2*b* are graphs comparing air induction of a conventional engine with an active reed valve engine.
Figure 2B:
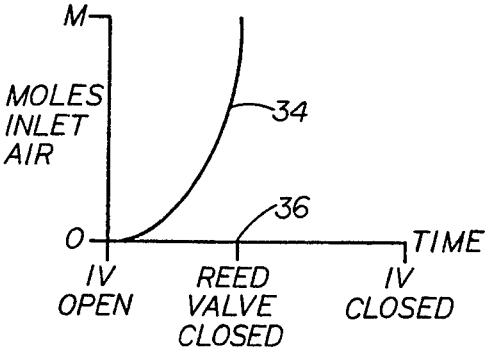

FIGS. 2*a* and 2*b* illustrate by comparison a throttled engine in FIG. 2*a* and new reed valve controlled engine in FIG. 2*b*. In FIG. 2*a* the mass of air or air/fuel mix flows into the cylinder following a somewhat "S" shaped curve 32 as a result of throttling effects until the total mass "m" under part engine load is reached at the instant the inlet valve closes. With the new reed valve the air or air/fuel mix flows into the cylinder to reach the total mass m under part engine load in less crank angle degrees because of the unthrottled flow. The flow 34 of air or air/fuel mix is cut off by the closure of the reed valve at an earlier instant of crank angle 36.

Figure 3A:
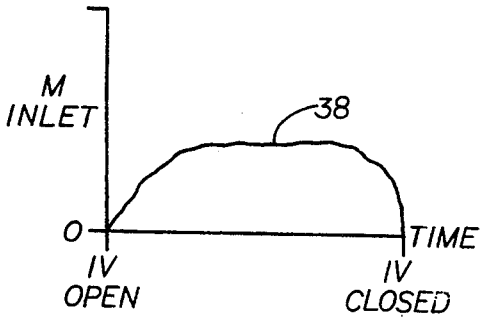
FIGS. 3*a* and 3*b* are graphs comparing inlet mass flow rate of a conventional engine with an active reed valve engine.
Figure 3B:
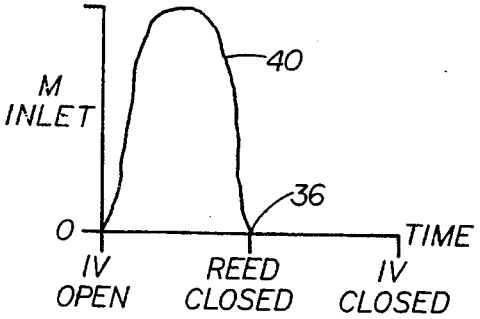

FIGS. 3*a* and 3*b* illustrate by comparison the mass flow rate M for tile throttled and unthrottled engines respectively. For comparison the brake mean effective pressure (bmep) and air/fuel ratio for each engine are the same and therefore the area under each curve 38 and 40 is the same. However, the curve 38 in FIG. 3*a* is much lower and longer in crank angle degrees than the curve 40 in FIG. 3*b*. The thermodynamic efficiency, however, is improved by the unrestricted flow of air or air/fuel mix in the active reed valve engine of FIG. 3*b*. The higher mass flow rate M in the new reed valve controlled engine causes complete cylinder charging to occur more quickly.

Under part load engine operation after the active reed valve closes, the piston continues its motion expanding the cylinder volume and therefore expanding the fresh charge of air or air/fuel mix in the cylinder and inlet manifold volume between the reed valve 24 and the inlet valve 22. Upon closure of the inlet valve 22, the air or air/fuel mix trapped between the inlet valve 22 and reed valve 24 remains at the pressure existing therein at the moment the inlet valve closed. The pressure of the trapped charge is, in general, lower than the pressure in the inlet manifold upstream of the closed reed valve.

To better control and improve the flow of air or air/fuel mix, it is preferable to open the active reed valve just before the inlet valve opens to start the air or air/fuel charge into the trapped downstream charge. The opening instant in crank angle degrees can be tuned to each individual engine for maximum momentum charging and increased volumetric efficiency at every speed and load condition. Thus, dynamic tuning can be used to further improve volumetric efficiency of the engine.

As the active reed valve 24 first opens a throttling loss does occur as air or air/fuel mix flows into the downstream trapped charge region before the inlet valve begins to open. The throttling loss continues until the reed valve is sufficiently open to cause equalization of pressure to either side of the reed valve. The throttling loss associated with the initial reed valve opening can be minimized by minimizing the inlet manifold volume between the inlet valve and the reed valve.

The active reed valve is preferably mounted to seal tightly when the lower pressure in the trapped charge downstream of the valve occurs. In addition, the opening in the manifold 20 through which the connecting pin 30 passes should be sealed.

Figure 4:
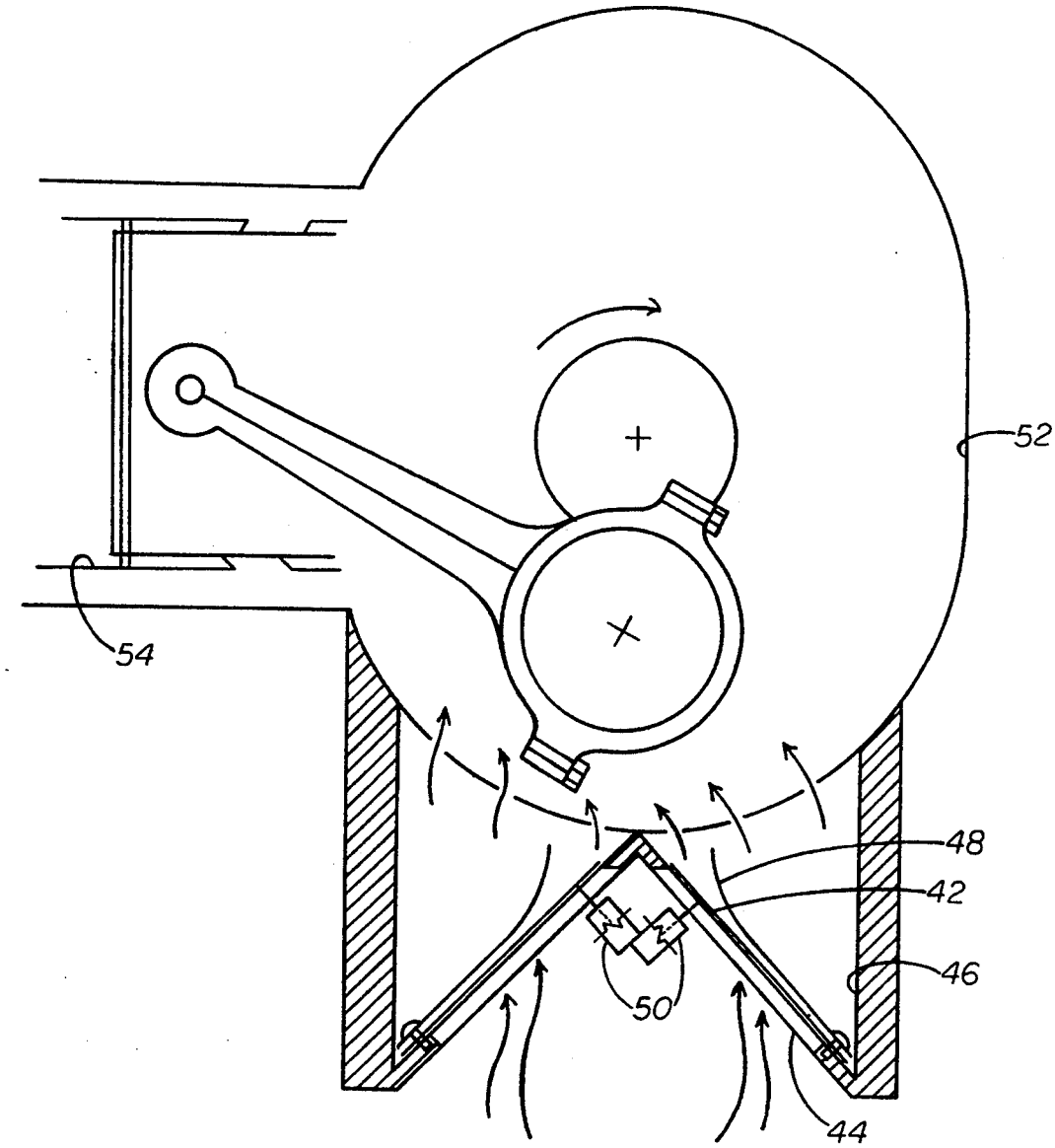
FIG. 4 illustrates schematically multiple active reed valves on a crank case scavenged two stroke engine.

FIG. 4 illustrates the application of the active reed valve to a crankcase scavenged two stroke engine. A plurality of reeds 42 are mounted on a wedge shaped valve body 44 in turn mounted in the inlet manifold 46 of the engine. Stop plates 48 for the reeds limit reed movement. Solenoid activators 50 actively move the reeds 42 to control the flow of charge to the crankcase 52 and cylinder 54. In this embodiment relative crankcase vacuum promotes reed opening therefore the reeds 42 must be held tightly closed by the solenoid activators 50 to assure that the charge trapped in the inlet manifold 46 and crankcase 52 is controlled to control momentum charging effects.

Figure 5:
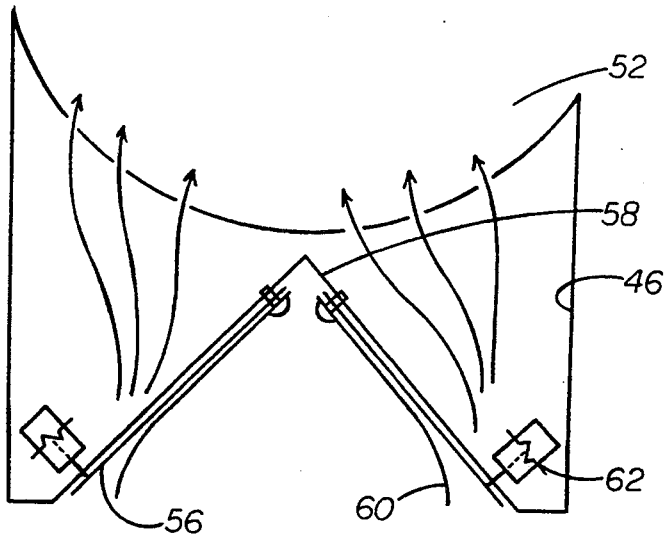
FIG. 5 illustrates schematically a modification to the reed valve assembly shown in FIG. 4.

In the alternative the reeds 56 in FIG. 5 are mounted on the upstream side of the wedge shaped valve body 58. The reeds 56 are otherwise limited by stops 60 and activated by solenoids 62. In this embodiment the reeds 56 naturally tend to seal upon closure as the piston movement causes a partial vacuum in the crankcase.

Figure 6A:
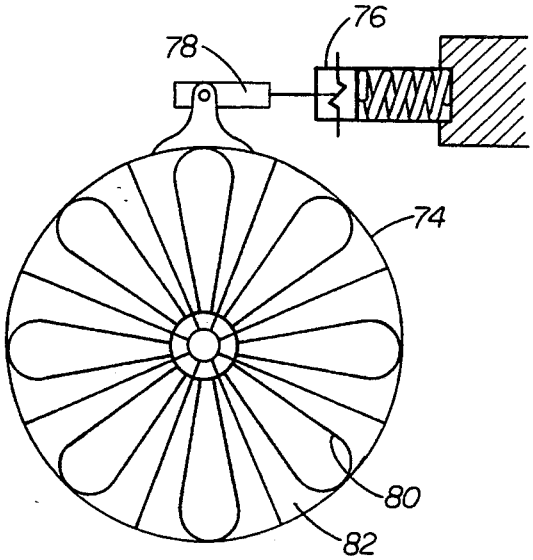
FIGS. 6*a* and 6*b* illustrate schematically a rotatable disc valve.
Figure 6B:
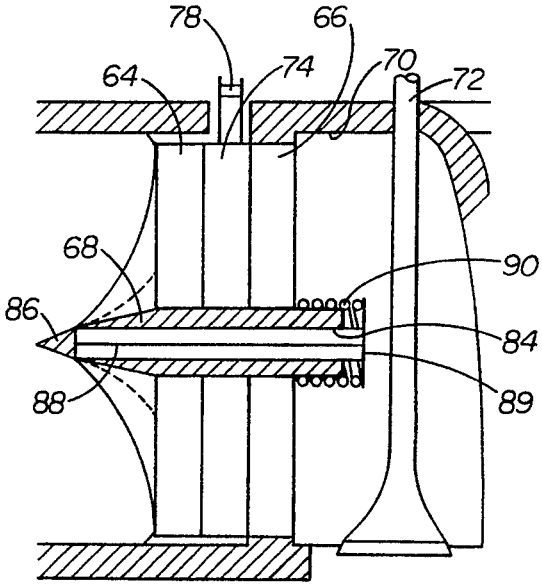

In FIGS. 6*a* and 6*b* a rotational disc valve is illustrated as applied to a poppet valved engine. This disc valve comprises a pair of discs 64 and 66 mounted on a central shall 68. Rear disc 66 is also affixed to the inside of the inlet manifold 70 in turn leading to an inlet poppet valve 72. Rotatable on the shaft 68 is a disc 74 to which is connected an external solenoid 76 and connecting rod 78. Discs 64, 66 and 74 are perforated by a plurality of slots 80. The solid areas 82 between the slots 80 in disc 74 are at least sufficient to close the slots in discs 64 and 66 upon activation of the solenoid 76. Thus, by reciprocating the disc 74 rotationally, the disc valve may be opened and closed in the same manner as the reed valve above. The amount of rotation is determined by the angular spacing of the slots 80.

As an added feature, the shaft 68 is hollow 84 with a moveable nose 86. The nose 86 is connected to a rod 88 leading to a perforated plate 89 and spring 90. In the event of engine backfire the nose 86 will open allowing gases to escape through the perforated plate 89 and hollow 84.

Figure 7:
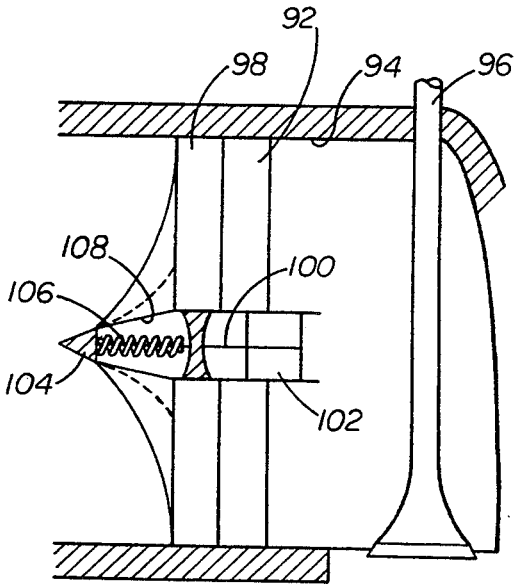
FIG. 7 illustrates schematically a modified form of the rotatable disc valve of FIG. 6.

FIG. 7 illustrates a modified disc valve having a stationary perforated disc 92 mounted in the inlet manifold 94 leading to the inlet poppet valve 96. The moveable disc 98 is mounted on the shaft 100 of a rotary activator 102. The rotary activator may be a stepper motor to rotationally index the moveable disc 98 or a reciprocable rotary activator. The rotary activator 102 is mounted in the center of stationary disc 92 and the shaft 100 extends to the nose 104. This disc 98 is free to move axially on the shaft 100 and is urged against the disc 92 by a spring 106 within the hollow region 108. A spline or other means provide axial freedom with rotational engagement for the attachment of the disc 98 to the shaft 100. In normal operation a tight seal can be maintained between the discs 92 and 98 when the valve is closed. In the event of engine backfire, disc 98 will be driven against the spring 106 momentarily to relieve the backpressure and prevent damage. The slotted disc valve and poppet valve combination per cylinder are applicable to four cycle engines and two cycle poppet valved and supercharged engines that are not crankcase scavenged.

Figure 8A:
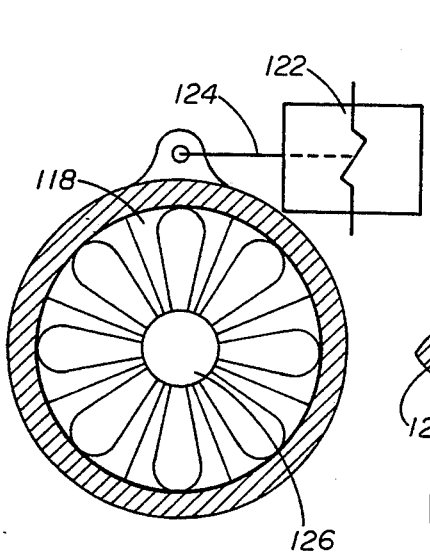
FIGS. 8*a* and 8*b* illustrate schematically the rotatable disc valve applied to a two stroke engine.
Figure 8B:
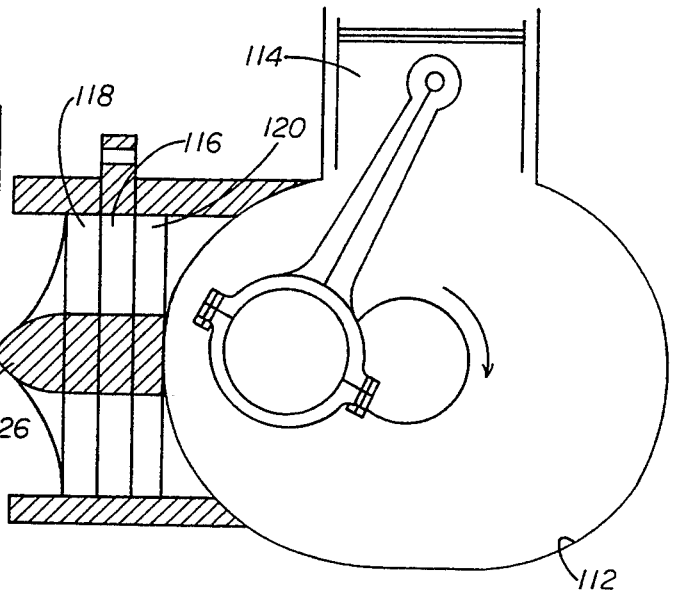

In FIGS. 8*a* and 8*b* the disc valve is applied to a crankcase scavenged two stroke engine having a crankcase 112 and piston 114. In this embodiment the valve comprises a perforated rotatable disc 116 mounted between a pair of perforated stationary discs 118, and 120. The rotatable disc 116 is activated by a solenoid 122 and connector 124, and is mounted for rotational reciprocation on a central shaft 126.

Figure 9:
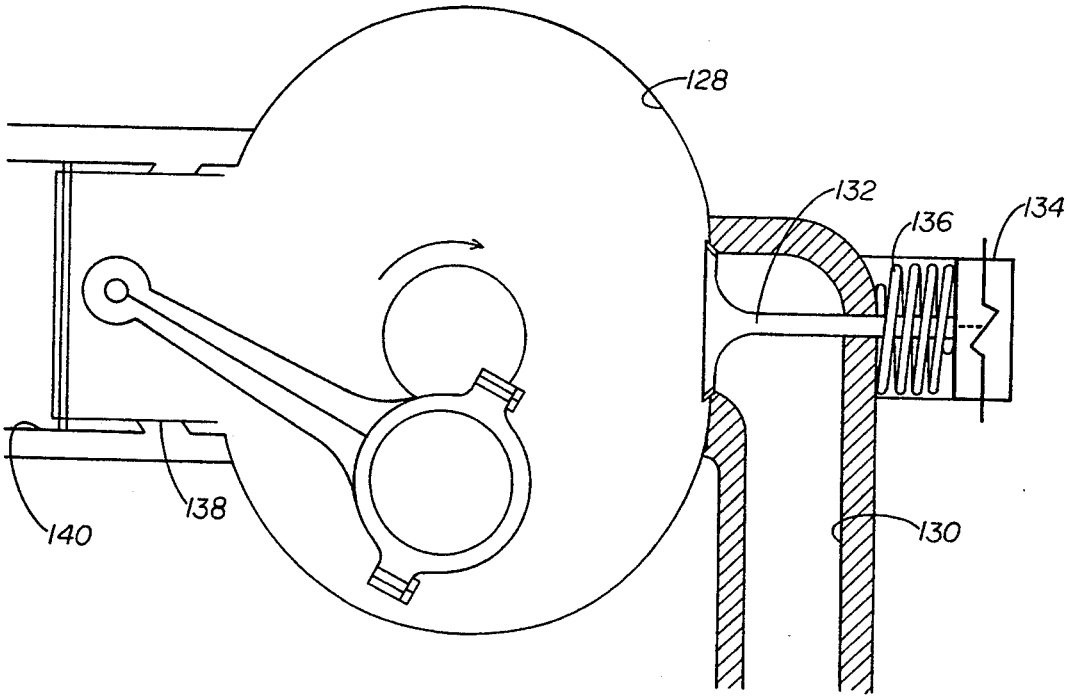
FIG. 9 illustrates schematically an active solenoid driven poppet valve on a two stroke engine.

In FIG. 9 the two stroke engine crankcase 128 is in communication with the intake manifold 130 through a poppet valve 132. The poppet valve 132 is opened by a solenoid 134 in turn energized by an electronic control unit. The poppet valve 132 is urged closed by a spring 136. As with the above two stroke engines the time the poppet valve is open is determined by engine load and is for a shorter duration than the time the inlet port 138 is open to the cylinder 140.

Returning to the configuration shown in FIG. 1 the active reed valve may be applied to a supercharged poppet valved two cycle engine. As shown in FIG. 1 the reed valve 24 is mounted to the inside of the inlet manifold 20 in turn leading to an inlet poppet valve 22. During the downward power stroke of the piston both the inlet 22 and exhaust 14 valves are closed until shortly before bottom dead center. Just before bottom dead center the active reed valve 24, inlet valve 22 and exhaust valve 14 open and pressurized fresh air or air fuel mixture are pumped by the supercharger through the inlet manifold 20, active valve 24 and poppet vale 22 into the cylinder 10. The incoming fresh charge expels the exhaust through the exhaust valve 14 and manifold 16.

At a selectable appropriate instant of crankage as the piston 12 moves upward the active reed valve 24 closes, shutting off flow from the supercharger. This closing occurs prior to the closing of the inlet 22 and exhaust 14 valves. With the closing of the inlet 22 and exhaust 14 valves, the fresh charge is trapped in the cylinder. Therefore, the control of engine load and output can be achieved by varying the amount of time in crank angle degrees the reed valve 24 remains fully open when both the inlet 22 and exhaust 24 valves are open.

With a supercharged two cycle poppet valve engine the timing and location of the valves are more readily adjustable than with a ported engine. The addition of the active reed valve further substantially reduces or eliminates throttling losses.

Figure 10:
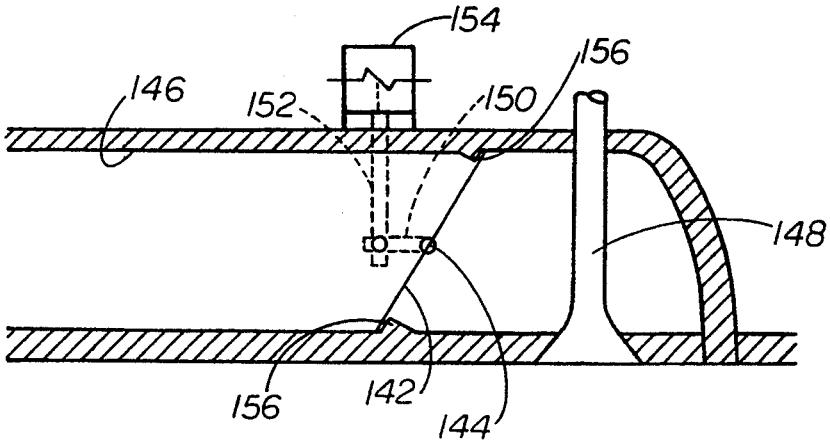
FIG. 10 illustrates schematically an active rotatable throttle type plate adjacent to the inlet valve of a four stroke engine.

In FIG. 10 an alternative to the solenoid reed valve in a four stroke engine is illustrated. A rotatable plate 142 is affixed to a pivot shaft 144 within the inlet manifold 146 to the poppet valve 148. The pivot shaft 144 is affixed to a crank arm 150 in turn activated by a connecting pin 152 and solenoid 154. Stops 156 are incorporated in the inlet manifold 146 to provide a positive limit to the movement of the plate 142. As above activation of the solenoid 154 causes the plate 142 to fully open permitting unthrottled flow for a time duration in crank angle degrees determined by the load on the engine.

Figure 11:
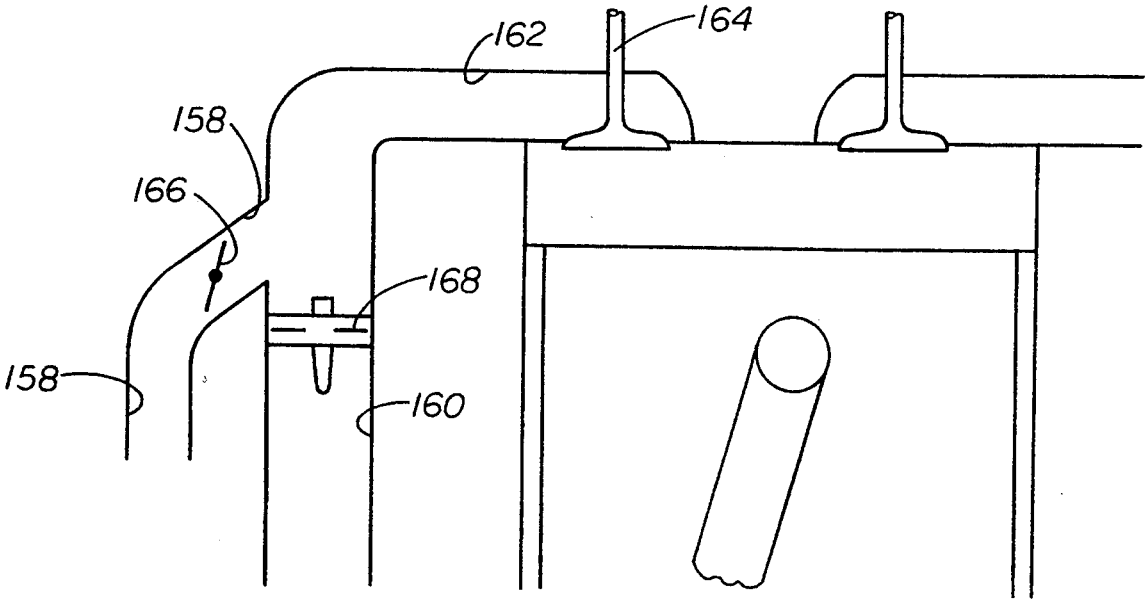
FIG. 11 illustrates a parallel bypass inlet manifold with an active valve in a four stroke engine.

In FIG. 11 a pair of inlet runners 158 and 160 merge into a single manifold runner 162 leading to the inlet poppet valve 164 of a four stroke engine. Runner 158 includes a throttle valve 166 and runner 160 includes an active disc valve 168 as described above. Thus, the throttle valve 166 is in parallel with the active disc valve 168. Under full load the throttle plate 166 may remain fully open for unrestricted flow of air or air/fuel mix. Under part load engine operation the active disc valve 168 controls the air or air/fuel mix. This combination allows the choice of a smaller diameter active disc valve 168. Moreover, under idle operation with a smaller active disc valve 168, the crank angle time open may be insufficient for full unrestricted air flow. Therefore, the air flow may be augmented by allowing some air to pass by the throttle valve 166.

Also applicable to all of the single active valve embodiments above is replacement of the single valve with two or more active valves per cylinder. In operation, the opening of the active valves is staged for control of inlet charge velocity into the cylinder. Under idle or light load and low speed, one active valve opens to provide a high charge velocity into the cylinder. As load or speed increases, both active valves open to reduce relative inlet charge velocity at high inlet charge flow rates. In this manner mixing, turbulence and swirl in the cylinder can be better controlled.

Figure 12:
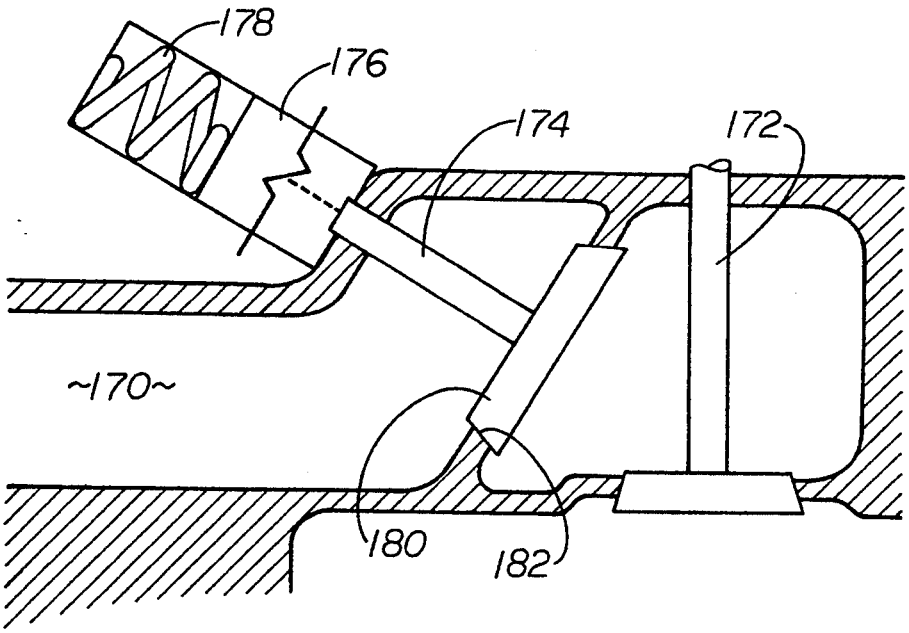
FIG. 12 illustrates schematically an active solenoid driven poppet valve on a four stroke engine.

In FIG. 12 the intake manifold 170 for a four stroke engine leads to a popper valve 172 that opens into the combustion chamber. This poppet valve 172 may be activated by a cam on a camshaft in a conventional manner. Just upstream from poppet valve 172 is a second active poppet valve 174. The second poppet valve 174 includes a solenoid 176 and return spring 178 in engagement with the stem of the poppet valve 174. The head 180 of the poppet valve 174 engages a seat 182 formed in the manifold 170. The annular opening formed when the poppet valve 174 is fully open is substantially greater than the annular opening about the popper valve 172 when fully open thus assuring that the air or air and fuel flow is virtually unimpeded by the popper valve 174.

The in-series poppet valve combination of FIG. 12 is also applicable to four cycle engines and two cycle engines that are not crankcase scavenged. The in-series popper valve combination is included because of the greater experience of the automobile industry in manufacturing popper valves; however, the reed valves and rotary valves tend to require less volume and add less weight to the engine.

Although the reed valve embodiments above appear less expensive to manufacture because the sealing of a disc valve requires closer tolerances over larger areas, both valves are suitable for mass production and can be activated by an electronic control unit. Typical inputs to the electronic control unit are the gas pedal position sensor, the exhaust carbon monoxide sensor, engine speed, inlet air mass flow meter, and such other inputs as necessary for emission control. From these inputs the opening and closing of the reed or disc valves can be controlled.

Under road load conditions, the new valves and timing are especially useful since most decrease in part load thermodynamic efficiency is caused by throttling losses. Fuel can be introduced to the air stream upstream or downstream of the new valve or directly through port or cylinder injection in the conventional manner. Care must be taken to avoid the natural frequency of the reed, connecting pin, solenoid combination and thereby avoid an uncontrolled movement of the valve.

Figure 13:
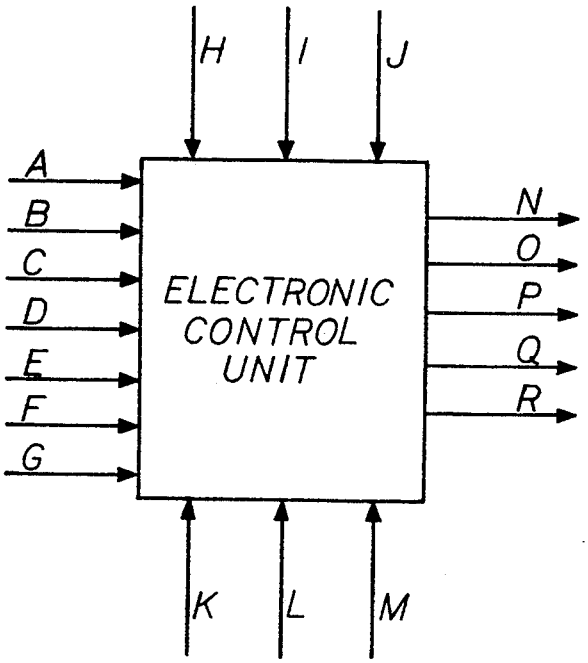
FIG. 13 illustrates schematically the input sensor and output control circuits for the electronic control module of a vehicle.

In FIG. 13 an electronic control unit (ECU) is illustrated with the typical current input parameters and output signals for actuation of engine and transmission components. The input parameters may be listed as follows:

A. Vehicle speed sensor.
B. Transmission gear selection indicator.
C. Mass air flow sensor.
D. Throttle (gas pedal) position sensor.
E. Wide open throttle cutout relay.
F. Exhaust oxygen sensors.
G. Air charge temperature.
H. Transmission shaft speed sensor.
I. Engine coolant temperature.
J. Transmission oil temperature.
K. Idle speed control bypass air.
L. Fuel pump monitor.
M. 12 volt battery power.

The output signals for actuation of engine and transmission components may be listed as follows:

N. Transmission shift signal.
O. Fuel injector actuation signal.
P. Spark ignition signal.
Q. Exhaust gas recirculation solenoid.

And for the active valves disclosed above, an additional output signal R to actuate the valves.

The (gas pedal) position sensor D. is an electromechanical device which converts the position of the gas pedal, throttle grip, lever arm or any other device which an engine operator may activate, to an electrical signal communicated to the ECU (D). The electrical signal may be proportional or disproportional to the position or change of position of the sensor. The position signal along with all of the above noted input signals are real time processed by the ECU. Logic internal to the ECU computes output command signals to each active valve solenoid to open each active valve at a particular crankangle and to close each active valve at a subsequent crankangle during the crankangle time the corresponding inlet valve is open.

Any change in the position of the gas pedal, throttle grip, lever arm or other device activating the throttle position sensor will change the duration of crankangle time that each active valve remains open during the inlet stroke. Thus, both the amount of fresh air or air and fuel mixture which enters the combustion chamber and the resultant power output of the engine are controlled without the imposition of a throttle and attendant throttling losses.

I claim:

1. In a two-stroke internal combustion spark ignition engine comprising at least one cylinder and a piston therein, a sealed crankcase in intermittent communication with the cylinder through an inlet port, an inlet manifold in communication with the crankcase through at least one reed valve, the improvement comprising electric solenoid means to activate the reed valve to open and close the manifold in response to the application and removal of electric energy, said reed valve of sufficient opening size to fully open the manifold for unthrottled air flow therethrough upon activation by electric energy, said reed valve upon activation being fully open regardless of engine load wherein air mass per inlet stroke is limited by the time period per inlet stroke said reed valve is open, and said solenoid means including armature and connection means between the solenoid armature and reed valve through which the solenoid activates the reed valve.

2. In a two stroke internal combustion spark ignition engine comprising at least one cylinder and a piston therein, a sealed crankcase in intermittent communication with the cylinder through an inlet port, an inlet manifold in communication with the crankcase through at least one reed valve, the improvement comprising electric solenoid means in close proximity to the reed valve to activate the reed valve to open and close the manifold in response to the application and removal of electric energy, said reed valve of sufficient opening size to fully open the manifold for unthrottled air flow therethrough upon activation by electric energy, said reed valve upon activation being fully open regardless of engine load wherein air mass per inlet stroke is limited by the time period per inlet stroke said reed valve is open.

* * * * *